United States Patent [19]

Schröder et al.

[11] Patent Number: 4,588,552

[45] Date of Patent: May 13, 1986

[54] PROCESS FOR THE MANUFACTURE OF A WORKPIECE FROM A CREEP-RESISTANT ALLOY

[75] Inventors: Günther Schröder, Birmenstorf; Robert Singer, Baden, both of Switzerland

[73] Assignee: BBC Brown, Boveri & Co., Ltd., Baden, Switzerland

[21] Appl. No.: 666,147

[22] Filed: Nov. 1, 1984

Related U.S. Application Data

[63] Continuation of Ser. No. 413,840, Sep. 1, 1982, abandoned.

[30] Foreign Application Priority Data

Sep. 3, 1981 [CH] Switzerland ..... 5693/81

[51] Int. Cl.[4] ..... B22F 1/00; B22F 9/00; C22C 1/04; C22C 19/03

[52] U.S. Cl. ..... 419/19; 29/DIG. 31; 148/126.1; 419/23; 419/28; 419/29; 419/31; 419/32; 419/43; 419/49; 419/50

[58] Field of Search ..... 148/126.1; 419/23, 28, 419/29, 30, 31, 32, 33, 43, 49, 50, 19; 29/DIG. 31

[56] References Cited

U.S. PATENT DOCUMENTS

| | | | |
|---|---|---|---|
| 914,372 | 3/1909 | Edison | 148/126.1 X |
| 3,041,716 | 7/1962 | Herenguel | 419/23 X |
| 3,179,516 | 4/1965 | Cross | 419/43 X |
| 3,361,599 | 1/1968 | Bargainnier et al. | 419/29 X |
| 3,508,320 | 4/1970 | Blue | 419/28 X |
| 3,685,134 | 8/1972 | Blue | 419/28 X |
| 3,746,581 | 7/1973 | Cairns et al. | 419/29 X |
| 3,802,938 | 4/1974 | Collins et al. | 419/29 X |
| 3,874,938 | 4/1975 | Benjamin et al. | 419/30 X |
| 3,976,482 | 8/1976 | Larson | 419/23 |
| 4,041,742 | 8/1977 | Rozmus | 419/30 X |
| 4,045,857 | 9/1977 | Suzuki | 419/6 |
| 4,066,449 | 1/1978 | Havel | 419/49 X |
| 4,094,709 | 6/1978 | Rozmus | 419/29 |
| 4,239,557 | 12/1980 | Thellmann et al. | 419/23 X |
| 4,274,873 | 6/1981 | Nadkarni | 419/23 X |
| 4,318,753 | 3/1982 | Anderson, Jr. et al. | 419/29 X |

OTHER PUBLICATIONS

Morse and Benjamin, "Mechanical Alloying", *New Trends in Materials Processing*; American Society for Metals; Seminar; Oct. 19–20, 1974 (pp. 165–199).

*Primary Examiner*—Mark Rosenbaum
*Assistant Examiner*—Ronald S. Wallace
*Attorney, Agent, or Firm*—Oblon, Fisher, Spivak, McClelland & Maier

[57] ABSTRACT

Manufacture of a workpiece from a creep-resistant nickel superalloy which is hardened by means of an oxide dispersion, by a powder-metallurgical process in which the mechanically alloyed powder is subjected to an isothermal or quasi-isothermal hot-rolling operation, in the course of which the powder particles are converted into a flake-shaped form with a pronounced longitudinal axes, and the rolled powder is introduced into a steel container and is compressed by isostatic hot-pressing. The workpiece is afterwards subjected to an annealing treatment which is designed to develop a coarse grain size. A preferred embodiment comprises the introduction of the powder into the mold or container in an oriented manner, in order to obtain a stratified packing of the powder, and an annealing treatment which is designed to develop a coarse grain size and is performed as a zone-annealing treatment.

9 Claims, 5 Drawing Figures

Figure 2:
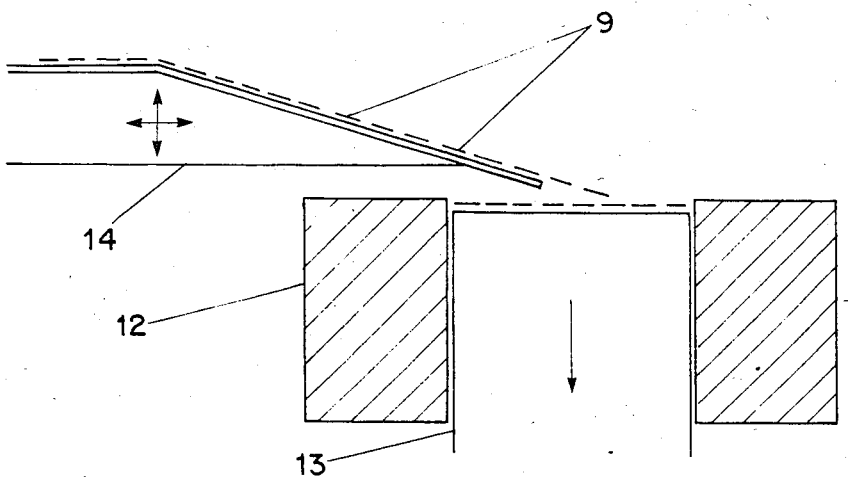

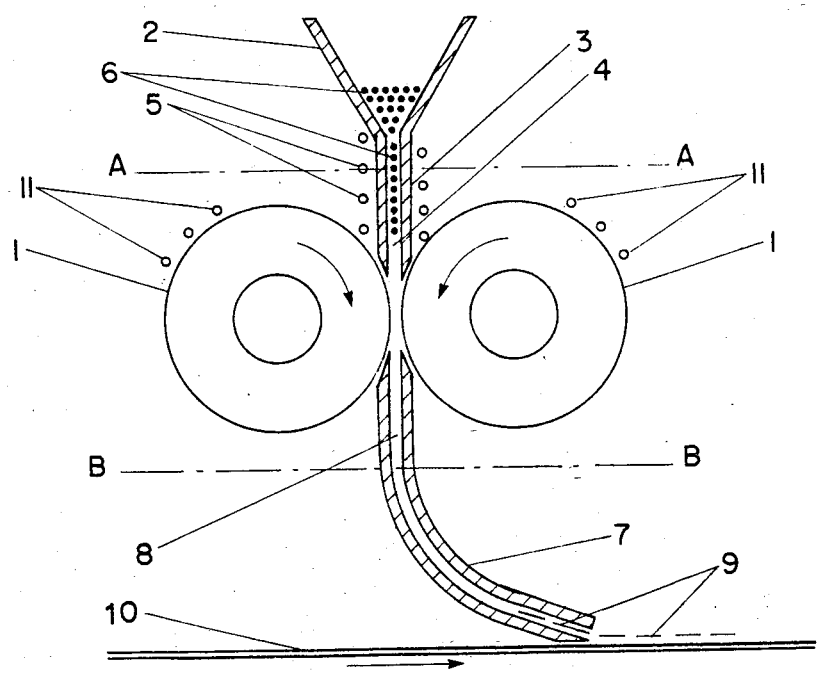
Fig. 1
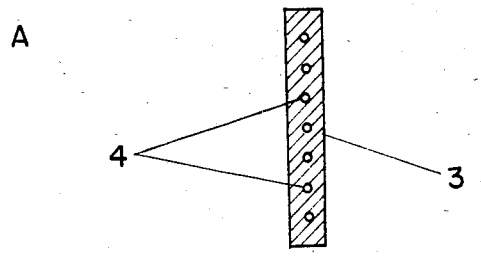
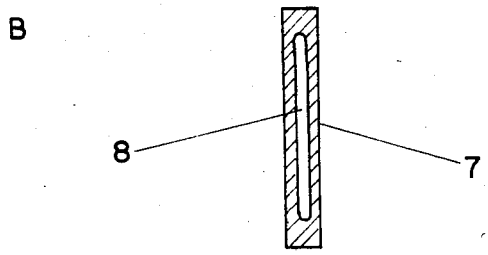

PROCESS FOR THE MANUFACTURE OF A WORKPIECE FROM A CREEP-RESISTANT ALLOY

This application is a continuation of application Ser. No. 06-413,180, filed Sept. 1, 1982, now abandoned.

The invention relates to a process for the manufacture of a workpiece from a creep-resistant austenitic alloy having a high nickel content and containing a metal oxide as a hardening dispersoid.

Alloys which are hardened by means of oxide dispersions, especially alloys of the nickel-based type, are generally manufactured by powder-metallurgical methods, and the powder particles are alloyed by mechanical means. In order to achieve the highest possible creep strength at high temperatures, alloys of this type must exhibit a coarse-grained structure in the finished, ready-to-use workpiece. The mechanical alloying processes and the related question of the further processing of the materials, which are hardened by means of oxide dispersions, are known (eg. J. P. Morse and J. S. Benjamin, "Mechanical Alloying", New Trends in Materials Processing, pages 165–199, in particular pages 177–185, American Society for Metals, Seminar 19th/20th October 1974). The mechanical alloying process may be defined as a method for producing composite metal powders with a controlled microstructure. The process consists of repeated fracturing and rewelding of a mixture of powder particles by the application of high-energy compressive-impact forces. The powder mixture must contain at least one fairly ductile metal to act as a host or binder. The other component may include other ductile metals, brittle metals (such as chromium), intermetallic compounds, nonmetals such as carbon, and hard compounds such as oxide. The process is usually carried out in high-energy stirred ball mills such as the Szegvari attritor grinding mill.

In each collosional event, many powder particles are entrapped between each pair of colliding milling balls. As the particles are plastically deformed, the surface-adsorbed layer of contaminants is ruptured and atomically clean metal is exposed. Where different powder particles overlap and deformation is severe enough, a cold pressure weld is formed.

There is a large increase in the hardness of the powders because of the substantial plastic deformation occurring during the mechanical alloying process. The hardness increases linearally during initial processing until a constant value called the saturation hardness is reached. The maintenance of that high-constant saturation hardness with further processing indicates that dynamic recovery probably occurs.

When oxide particles are added, as the individual metallic particles are bonded together by colliding milling balls, fine particles of the refractory oxide become entrapped in the weld interfaces. The repeated welding and fracturing during the process "kneads" these dispersoid particles into the composite powder much as a baker kneads raisins into bread dough. The effective interparticle spacing of the oxide particles at any given time is equivalent to the average lamellar thickness or the spacing between the welds. Early in the process, the oxide interparticle spacing within the weld interfaces is much smaller than the spacing between the welds. As processing continues, the oxide interparticle spacing within the welds increases, while the distance between the welds decreases. Eventually, a point is reached where these two values are equal to one another and attain a value equivalent to the random interparticle spacing calculated from the average oxide-particle size and volume fraction added.

The secondary recrystallization behaviour of a dispersion-strengthened superalloy is a function of the total energy content of the material prior to the high-temperature recrystallization heat treatment. This energy is composed of the energy of mechanical alloying and the energy added during consolidation and other thermal mechanical working. In order to obtain a finished workpiece, the preprocessed material, which has been obtained in accordance with previously conventional processes in a first compression-step (powder compaction) must be subjected to further shaping operations. Since the material costs and the cost of machining alloys of this type are both very high, this shaping can be carried out economically only by plastic deformation. At the end of all the processes, there is always a heat treatment which serves to transform the finished, shaped workpiece into the coarse-grained structural condition which is most suited to high-temperature operation.

However, the success of the annealing treatment designed to develop a coarse grain size, now depends on the entire previous history of the material. According to the methods customary hitherto, a 100%-dense preprocessed material is obtained on subjecting the powder, which has been cold-worked through being mechanically alloyed, to the first hot-compression step. This dense preprocessed material possesses a superfine grain structure, can easily be worked in the medium-to-high temperature range and, under certain conditions, exhibits superplastic properties. The preprocessed material can accordingly be converted, by plastic deformation, into the final shape of the finished workpiece comparatively easily. The only question is whether it is possible to develop the necessary coarse grain size in the finished final product, without difficulty, by means of an additional annealing treatment. Conventional practice now shows that the development of this coarse grain size is in no way guaranteed in all cases. On the contrary, it is necessary, as a rule, to adhere to very restrictive conditions which inconvenience the production process. The ability to establish a coarse grain size depends on the driving forces which are available. The manner whereby the preprocessed material was produced is highly significant. This can be effected, for example, by high-temperature or low-temperature extrusion, or by isostatic hot-pressing of the mechanically alloyed, encapsulated powder. The mechanical alloying process brings about, as a rule, a state in which the deformation is as great as possible, the work-hardening thus being forced to the saturation limit. This maximized deformation is relieved to a greater or lesser degree during the subsequent thermomechanical working-steps. Practical experience shows that the state of deformation of the preprocessed ("normal") material can be optimized for the subsequent development of a coarse grain size. If, on the other hand, the preprocessed material has been deformed at a comparatively low rate and at a comparatively high temperature, it possesses too little energy for the subsequent recrystallization process and the latter does not proceed to completion (mixture of unrecrystallized fine-grained material with a few coarse grains), or does not occur at all. If, however, the preprocessed material is deformed at a comparatively high rate and a comparatively low temperature, it possesses an excess of energy for the subsequent recrystallization process which proceeds to completion but produces, as a result of an excessive number of crystallization nuclei, only a comparatively fine-grained structure. No additional heat-treatment is capable of transforming this fine-grained structure into a coarse-grained one.

It has already been proposed that the preprocessed material, manufactured from mechanically alloyed, cold-compressed powder by extrusion, isostatic hot-pressing etc., be subjected to an additional, controlled thermomechanical treatment, in which the degree of deformation and the deformation rate are matched to the previous history of the preprocessed material (see Swiss Patent Application No. 6027/80-0). This presupposes, in most cases, the need to apply comparatively large deformations to the workpiece, which has already been compacted, so that the range over which there is freedom to vary the geometry in the final shaping operation is considerably restricted. The abovementioned procedure cannot accordingly always be applied to components of any desired shape.

Accordingly, there is a need to lift these restrictions which, in practice, affect the fabrication sequence and to be on the lookout for suitable methods which enable components to be designed with complete freedom in terms of their geometry.

The object underlying the invention is to indicate a process for the manufacture of a creep-resistant workpiece which is hardened by means of an oxide dispersed. This process produces, irrespective of the nature and number of the process-steps, a coarse grained final product which can, in every case be used under service conditions.

The invention is described with the aid of the illustrative embodiments which follow and which are explained by means of Figures, in which:

FIG. 1. shows an appliance, in diagrammatic form, in 3 sections, for the purpose of explaining the powder-rolling operation.

FIG. 2. shows the beginning of the operation in which the rolled powder is introduced into a mold.

Figure 3:
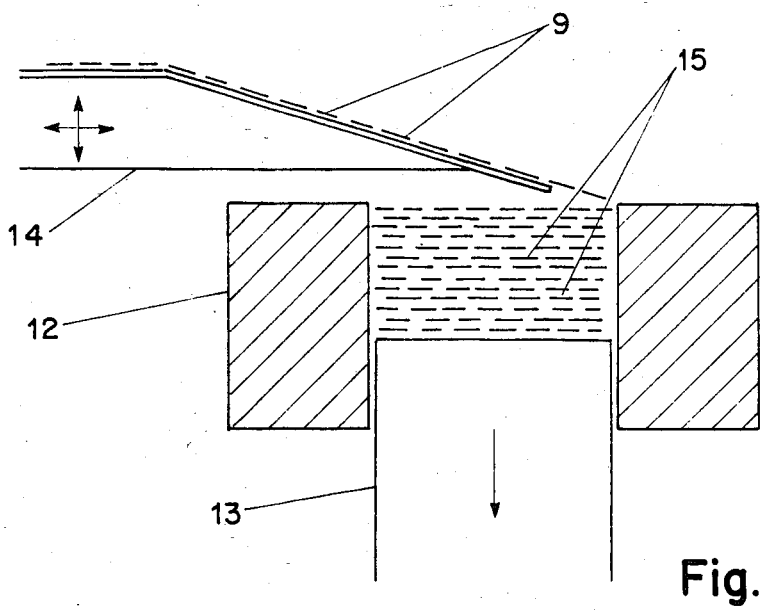

FIG. 3. shows the advanced state of the operation in which the rolled powder is introduced into a mold.

In order to explain the characteristic process-step in which the powder is subjected to a rolling operation, an appliance is represented in FIG. 1, in diagrammatic form, in one section in elevation, and in two sections in plan view. The cylindrical rolls 1, which are combined to form a pair and are driven in opposite directions, leave a narrow roll-gap open, into which the equiaxed powder particles 6 flow via a filling hopper 2 and a feeder element 3, the latter being provided with cylindrical bores 4, the longitudinal axes of which are parallel and coplanar. An induction-heating device is represented by 5, this device heating the feeder element 3. An induction-heating device 11 is additionally provided for heating the rolls. After the rolling operation, the flake-shaped powder particles 9 are led off via the offtake duct 7, which is provided with a narrow slot 8 for the purpose of receiving the powder particles 9, the principal symmetry-plane of this slot coinciding, in the upper portion, with those of the bores 4 in the feeder element 3 and standing perpendicular to the symmetry-plane passing through the axes of the rolls. In the lower portion, the offtake duct 7 is bent in such a manner that it runs out at an acute angle to the conveyor belt 10. The plan-view sections A and B are represented in the lower portion of FIG. 1, these sectional views permitting the duct cross-sections (bore 4 and slot 8) to be recognized, which are provided for the powder particles 6 and 9 respectively.

The operation in which the rolled powder is introduced into a mold is shown diagrammatically in FIG. 2, at the beginning of this process-step. A counter-plunger 13 is located in the hollow mold 12, in a manner permitting vertical movement (see the downward-pointed arrow). A vibratory conveying chute 14 which can move freely in all directions, is located above the mold 12, this chute transporting the powder particles 9 to the desired points inside the mold 12. The vibration of the chute 14, and its shifting drive, in both the longitudinal and transverse directions, are indicated by crossed arrows.

The operation whereby the rolled powder is introduced into a mold is shown diagrammatically in FIG. 3, in the advanced state of this process-step. The powder packing which has already been deposited, in an aligned and stratified manner, in the mold 12, is represented by 15, while the remaining reference numbers correspond to those of FIG. 2.

ILLUSTRATIVE EMBODIMENT I

See FIG. 1.

The starting material was a mechanically alloyed powder mixture having the following composition:

| | |
|---|---|
| C | 0.05% by weight |
| Cr | 15% by weight |
| Mo | 2% by weight |
| W | 4% by weight |
| Al | 4.5% by weight |
| Ti | 2.5% by weight |
| Ta | 2% by weight |
| Zr | 0.15% by weight |
| B | 0.01% by weight |
| $Y_2O_3$ | 1.1% by weight |
| Ni | Remainder |

The powder particles were irregular, roughly spherical in shape, (equiaxed), and had a mean diameter $h_o$ of approximately 500$\mu$. The powder particles were hot-rolled in the appliance according to FIG. 1, at 1,000° C., care being taken to prevent any compaction (comparatively large agglomerations, formation of a strip), the following deformation conditions being maintained:

$$\epsilon = |\ln (h_f/h_o)| = 1.43$$

$h_o$=mean particle diameter before the rolling operation $h_f$=mean particle thickness after the rolling operation, $$\dot{\epsilon} = \frac{d\epsilon}{dt} = \frac{v_r}{\sqrt{R \cdot h_o}} \cdot \sqrt{r}\left(1 + \frac{r}{4}\right) = \underline{6\ s^{-1}}$$

$$r = \frac{h_o - h_f}{h_o}$$

$v_r = 2\pi R\nu$=peripheral speed of the rolls in m/s

R=Radius of the rolls, in m $\nu$=Rotation speed of the rolls, in revolutions per second and $$\dot{\epsilon}/D = 2 \cdot 10^{16}\ m^{-2},$$

in which expression D is a diffusion coefficient defined by the following expression, $$D = 1.5 \cdot 10^4 \exp\left(-\frac{3.4 \cdot 10^4}{T}\right), \text{ in } m^2/s,$$

where T=Temperature, in Kelvin
m=Unit of length, in meters
s=Unit of time, in seconds After the rolling operation, the powder particles were flake-shaped, elongated in the rolling direction, and exhibited a mean thickness $h_f$ of approximately 120μ. Examination showed that the mean particle-volume had approximately doubled as a result of the hot-rolling operation. Attention should furthermore be drawn to the fact that the original particle-volume may, after the rolling operation, have increased up to a factor of 5. The rolled powder were thereupon introduced into a container, made of soft steel, and hermetically sealed. The encapsulated powder was isostatically hot-pressed for 4 hours, under a pressure of 135 MPa at 900° C. The pressed workpiece was finally subjected to a heat-treatment in the form of a zone-annealing operation. The maximum local temperature was 1200° C., the temperature gradient aligned parallel to the longitudinal axis of the rolled powder particles, perpendicular to the direction of advance of the annealing zone, $\Delta T/\Delta x$, was 17° C./mm while the annealing zone advanced at a speed of 1.9 mm/min. The result, in the final product, was a structure of coarse elongated crystallites, none of their axes being smaller than 100μ.

ILLUSTRATIVE EMBODIMENT II

See FIGS. 1 To 3.

The starting material was identical to that of Example 1, as were the deformation conditions during the rolling of the powder particles. The rolled powder was introduced into a steel container, in an aligned manner, by means of an appliance according to FIGS. 2 and 3. During this filling operation, care was taken to ensure both that the directions normal to the planes of the flake-shaped particles came to be roughly parallel to each other, and that their longitudinal axes were also aligned approximately parallel to each other.

The powder particles were thus uniformly oriented in a double sense. Attention should be drawn to the fact that even a single orientation, namely either parallel directions normal to the planes of the particles, or parallel longitudinal axes, offers, on its own account, advantages compared to the introduction of the powder in a disordered manner. After having been introduced into a steel container, the powder was then subjected to the same thermomechanical and thermal treatments as in Example I: isostatic hot-pressing and zone-annealing. The structure exhibited elongated crystallites, none of their axes being smaller than 100μ. In comparison with Example I, the crystallites were markedly longer, so that this method of establishing a coarse grain size proved to be particularly advantageous. In some cases, it was even possible to dispense with the zone-annealing treatment, and to carry out a normal annealing treatment for developing a coarse grain size. Nevertheless, the aim will generally be to produce a structure composed of the longest possible, aligned grains, so that the superposition of the two effects, of the longitudinally aligned, parallel, rolled particles, and of the zone-annealing treatment is desired.

The powder particles can, quite generally, be introduced into a ductile metal container which does not necessarily have to be made of steel. For certain purposes, copper and copper alloys are also suitable container materials, as are other ductile materials. Furthermore, the process can be applied, quite generally, to the type of alloy indicated in the Examples as well as to related dispersion-hardened, high-nickel austenitic superalloys. The powder-rolling operation can be carried out by means of heated rolls, isothermally or quasi-isothermally, the temperature of the rolls being, in the latter case, below that of the powder. The annealing treatment for developing a coarse grain size can advantageously take the form of a zone-annealing treatment, producing an elongated, aligned grain structure. Particularly, it is advantageous, for zone-annealing treatment to be carried out in such a manner that the temperature gradient lies in a plane which is parallel to the principal plane of the flake-shaped, parallel-stratified powder particles, or is parallel to the longitudinal axis of the unidirectionally oriented powder particles. Following the isostatic hot-pressing operation, the workpiece can be subjected to one or several further working steps, if there are metallurgical reasons and/or reasons relating to shaping technology which call for further deformation. Further working steps of this type can comprise, for example, a forging operation, a rolling operation, a pressing operation, a swaging operation or a hot-rolling operation.

The process according to the invention had considerably widened the design possibilities, in respect of the structure-related and shape-related engineering for manufacturing, by the powder-metallurgical route, coarse-grained workpieces from dispersion-hardened alloys with high nickel contents. In accordance with this process, it is always possible to obtain a satisfactory coarse-grained structure in the final product, this result being substantially independent of the geometry to be achieved in the workpiece and of the nature and number of the working steps which are, in total, required or desired.

We claim:

1. A process for the manufacture of a workpiece, having high creep strength at high temperatures, from a high-nickel alloy which contains a metal oxide as a hardening dispersoid, comprising the following steps:

(a) preparing randomly shaped particles of a mechanically alloyed, dispersoid containing metal powder comprising a metallic alloy and a metal oxide dispersoid by bonding metallic powders and fine metallic oxide particles through a mechanical alloying process, (b) subjecting said particles of mechanically alloyed metal powder to a hot or warm rolling process, effecting non-work hardening deformation, thereby deforming said randomly shaped particles into elongated flaked shapes such that the original volume of the particles increases by no more than a factor of 5.0 and the degree of deformation, $\dot{\epsilon}$, is greater than 0.1, where $$\dot{\epsilon} = |\ln(h_f/h_o)|,$$

in which $h_o$, denotes the mean particle diameter before the rolling operation and $h_f$ denotes the mean particle thickness after the rolling operation, and wherein the deformation rate $$\dot{\epsilon}=de/dt$$

is maintained within the limits such that $$10^{15}(m^{-2})<\dot{\epsilon}/D<10^{20}(m^{-2})$$

$\epsilon$ being defined as $$\dot{\epsilon}=\frac{v_r}{\sqrt{R\times h_o}}\times\sqrt{r}\left(1+\frac{r}{4}\right),$$

$$\text{wherein } r=\frac{h_o-h_f}{h_o}$$

$v=2\pi R\nu$=Peripheral speed of the rolls, in m/s
R=radius of the rolls, in m
$\nu$=rotation speed of the rolls, in revolutions per second and D is the diffusion coefficient, represented by the equation $$D=1.5\times10^{-4}\exp\left(-\frac{3.4\times10^4}{T}\right)\ m^2/s,$$

T=Temperature, in Kelvin
m=unit of length, in meters
s=unit of time, in seconds (c) encapsulating the resulting metal powder flakes in a metal container, and (d) subjecting said metal powder flakes to thermal-mechanical temperature by an isostatic hot-pressing operation, and then (e) immediately subjecting said treated metal powder flakes to an annealing thermal treatment operation to obtain the finished coarse grained workpiece.

2. The process of claim 1, wherein $\epsilon$ is greater than 1.

3. The process of claim 1, wherein at least one hot-working step is carried out, after said isostatic hot-pressing step (d) and before said annealing step (e), wherein said hot-working step may comprise a forging step, a rolling step, a pressing step, a swaging step or a hot-drawing step.

4. The process of claim 1, wherein said powder metal is introduced into said metal container (c) such that the direction normal to the plane of the flake-shaped particles is parallel to the workpiece.

5. The process of claim 1, wherein said powder metal is introduced into said metal container such that the longitudinal axes of the flake-shaped particles are parallel to the workpiece.

6. The process of claim 1, wherein said powder metal is introduced into said metal container such that both the directions normal to the planes of the flake-shaped particles and the longitudinal axes of the particles are aligned such that the directions are always parallel to each other and the longitudinal axes of the particles are always parallel to each other, and the longitudinal axes of the particles are parallel to the workpiece.

7. The process of claim 1, wherein said annealing operation is a zone-annealing treatment, wherein elongated, aligned coarse grained particles are produced.

8. The process of claim 1, wherein said annealing operation is a zone-annealing treatment, wherein the temperature gradient lies in a plane parallel to the plane of the flake-shaped, parallel-stratified powder particles.

9. The process of claim 1, wherein said annealing operation is a zone-annealing treatment, wherein the temperature gradient is aligned parallel to the longitudinal axes of the rolled powder particles, wherein elongated, aligned coarse grained particles are produced.

* * * * *